United States Patent [19]

Houtkamp

[11] 4,201,797

[45] May 6, 1980

[54] PROCESS FOR APPLYING A LIGHT-ABSORBING, ELECTRON PERMEABLE LAYER WITHIN AN IMAGE INTENSIFIER TUBE

[75] Inventor: Johannes J. Houtkamp, Delft, Netherlands

[73] Assignee: N.V. Optische Industrie "De Oude Delft", Delft, Netherlands

[21] Appl. No.: 841,067

[22] Filed: Oct. 11, 1977

[30] Foreign Application Priority Data

Oct. 20, 1976 [NL] Netherlands ..... 7611593

[51] Int. Cl.[2] ..... H01J 31/26; H01J 9/22

[52] U.S. Cl. ..... 427/66; 427/77; 427/78; 427/109; 427/123; 427/255; 316/3; 316/5; 316/6; 316/7; 316/9; 316/10; 427/255.7

[58] Field of Search ..... 427/66, 77, 78, 109, 427/255, 248 J, 166, 123; 316/3,5,6,7,9,10; 313/94, 101, 102, 466

[56] References Cited

U.S. PATENT DOCUMENTS

| | | | |
|---|---|---|---|
| 3,040,201 | 6/1962 | Lehmann | 427/66 |
| 3,167,677 | 1/1965 | Fremuth | 427/66 |
| 3,692,576 | 9/1972 | Takayanagi | 427/77 |
| 3,984,581 | 10/1976 | Dobler | 427/166 |

OTHER PUBLICATIONS

Powell et al., *Vapor Deposition*, pp. 346–349 & 403–404, (1966), John Wiley & Sons Inc. N.Y.

*Primary Examiner*—Michael F. Esposito
*Attorney, Agent, or Firm*—O'Brien and Marks

[57] ABSTRACT

A process for applying within an image intensifier tube, in particular one of the proximity-focus type, a light absorbing, electron permeable layer on to a film coated on a layer of luminescent material applied to the anode of the tube. The layer is applied by evaporation of a low atomic weight element, preferably silicon or boron, or a compound of such an element, under conditions of high vacuum, preferably in the range of $10^{-5}$ to $10^{-6}$ torr, and up to a thickness of $\frac{1}{4}\lambda$, where $\lambda$ is the average wavelength of the light which during operation of the tube impinges upon the photocathode thereof.

4 Claims, No Drawings

PROCESS FOR APPLYING A LIGHT-ABSORBING, ELECTRON PERMEABLE LAYER WITHIN AN IMAGE INTENSIFIER TUBE

This invention relates to a process for applying a light-absorbing, electron-permeable layer within an image intensifier tube.

Image intensifier tubes comprise a photocathode and an anode spaced from the cathode. The anode is commonly a light-transparent substrate comprising, for example, a glass output window or a fibre-optics system, a layer of luminescent material being applied to the substrate in the interior of the tube. Normally an aluminum film is provided to overlie the luminescent layer. The aluminum film has a number of functions, including the protection of the luminescent layer from alkali metal vapours during the formation of the tube and the reflection of light generated upon the incidence of electrons in the luminescent layer and directed towards the interior of the tube.

It is clear that the aluminum film also reflects light that penetrates the tube through the photocathode. This light is partly reflected back to the cathode, where it releases photoelectrons which have a deleterious effect and reduce the image quality of the tube.

It is well-known to provide a remedy for this effect by applying aluminum through evaporation in a nitrogen atmosphere, i.e., an atmoshpere consisting in full or in part of nitrogen, and at a relatively low pressure of approximately $10^{-1}$ to $10^{-2}$ torr. This procedure is productive of a black film, which substantially absorbs the light penetrating through the cathode.

It has been found, however, that this process is difficult to perform and its results are poorly reproducible. An attendant difficulty of this method is that the parts surrounding the anode are contaminated.

It is an object of the present invention to eliminate the difficulties outlined above.

According to the present invention, there is provided a process for applying within an image intensifier tube, in particular one of the proximity-focus type, a light absorbing, electron permeable layer on to a film coated on a layer of luminescent material applied to the anode of the tube, the improvement which comprises applying said light absorbing layer by evaporation of a low atomic weight element, or a compound of such elements, under conditions of high vacuum and up to a thickness of approximately $\frac{1}{4}\lambda$, where $\lambda$ is the average wavelength of the light which during operation of the tube impinges upon the photocathode thereof.

It has been found that, of the low atomic weight elements referred to, silicon and boron are very satisfactory. An additional advantage of the use of these elements is that they both have an extremely low vapour pressure. This implies that in the manufacture of the tube, employing temperatures in the order of 400° C., the high vacuum is not adversely affected.

The process of this invention has proved to be a simple, clean and reproducible way of applying the light-absorbing layer, which layer has in addition, owing to its small thickness and the low atomic weight, a low electron absorption.

It should be noted that the thickness of the layer need not be rigorously equal to $\frac{1}{4}\lambda$, but can be varied somewhat in order that optimum adaptation to the spectral transmission of the photocathode be achieved.

For good results, it is preferred that the high vacuum has a value of approximately 10−5 to $10^{-6}$ torr.

Although the process of the present invention can be applied to any given type of image intensifier tube, its advantages are most prominent in image intensifier tubes of the so-called proximity-focus type. In tubes of the latter type, the photocathode and the anode are spaced a small distance from each other, as a consequence of which the chance of the emission of spurious electrons, as noted above, is greater than with image intensifier tubes of a different type, in which the electrode are spaced a larger distance apart.

The invention also relates to an image intensifier tube comprising a light absorbing layer produced by the process of this invention.

I claim:

1. A process for forming an anode for an image intensifier tube of the proximity-focus type which employs the anode closely spaced with a photocathode which releases photoelectrons, the process comprising the steps of applying a layer of luminescent material on a light-transparent substrate, applying a layer of aluminum on the luminescent material, and applying a low atomic weight element selected from the group consisting of boron and silicon to the layer of aluminum by evaporation under conditions of a high vacuum to form a layer thereon wherein the applying of boron or silicon is continued until the thickness of the layer theref is approximately one-fourth the average wavelength of light which impinges upon a photocathode of the image intensifier tube.

2. A process as claimed in claim 1, wherein said low atomic weight element is silicon.

3. A process according to claim 1, wherein said low atomic weight element is boron.

4. A process according to claim 1, wherein the high vacuum has a value of approximately $10^{-5}$ to approximately $10^{-6}$ torr.

* * * * *